US007946333B1

(12) United States Patent
Zapata

(10) Patent No.: US 7,946,333 B1
(45) Date of Patent: May 24, 2011

(54) DETACHABLE INSECT SCREEN SYSTEM INVOLVING A ZIPPER

(76) Inventor: Andres Zapata, Jensen Beach, FL (US)

( * ) Notice: Subject to any disclaimer, the term of this patent is extended or adjusted under 35 U.S.C. 154(b) by 291 days.

(21) Appl. No.: 12/100,203

(22) Filed: Apr. 9, 2008

(51) Int. Cl.
*E06B 9/00* (2006.01)

(52) U.S. Cl. ..... 160/368.1; 160/354

(58) Field of Classification Search ..... 160/90, 160/180, 368.1, 354
See application file for complete search history.

(56) References Cited

U.S. PATENT DOCUMENTS

| | | | | | |
|---|---|---|---|---|---|
| 2,391,871 | A | * | 1/1946 | Benson | 160/368.1 |
| 3,004,592 | A | * | 10/1961 | Norton | 160/114 |
| 3,251,699 | A | * | 5/1966 | Grossman | 501/125 |
| 3,480,069 | A | * | 11/1969 | Handwerker | 160/354 |
| 3,763,917 | A | | 10/1973 | Antinone | |
| 4,249,589 | A | * | 2/1981 | Loeb | 160/368.1 |
| 4,569,362 | A | | 2/1986 | Fidler, Jr. | |
| 5,046,546 | A | | 9/1991 | Benedyk et al. | |
| 5,323,835 | A | * | 6/1994 | Bachmeier | 160/89 |
| 5,358,025 | A | * | 10/1994 | Wood | 160/368.1 |
| 5,427,169 | A | * | 6/1995 | Saulters | 160/368.1 |
| 6,032,684 | A | | 3/2000 | Narron | |
| 6,079,473 | A | * | 6/2000 | Ackerson et al. | 160/368.1 |
| 6,192,643 | B1 | | 2/2001 | Zadok | |
| 6,289,963 | B1 | * | 9/2001 | Vaske | 160/89 |
| D461,562 | S | | 8/2002 | Hansen | |
| 2005/0055964 | A1 | | 3/2005 | Valles | |

* cited by examiner

*Primary Examiner* — Blair M. Johnson

(57) ABSTRACT

The invention is a detachable insect screen system that uses a zipper as the attaching means of the detachable panel. The insect screen system also incorporates a permanent panel that encompasses the detachable panel. The permanent panel connects to the surrounding structure and has an opening with the corresponding teeth for the zipper assembly. An alternative embodiment may use a plurality of snap buttons, hook and grommets, or hook and loop fastening means, as opposed to a zipper in order to make ingress and egress of the insect screen assembly.

1 Claim, 8 Drawing Sheets

DETACHABLE INSECT SCREEN SYSTEM INVOLVING A ZIPPER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of insect screen assemblies, more specifically, insect screen assemblies that attach via a zipper, a hook and loop fastener, a plurality of snap buttons, or a hook and grommet configuration.

B. Discussion of the Prior Art

The Fidler, Jr. Patent (U.S. Pat. No. 4,569,362) discloses a screened tent having panels that are detachable from the frame. However, the device disclosed under the Fidler Patent does not utilize a zipper as the means to connect the detachable panels.

The Valles Patent Application Publication (U.S. Pub. No. 2005/0055964) discloses a screened room enclosure that has detachable panels. However, the panels disclosed under the Valles Publication do not use a zipper as an attaching means to the rest of the enclosure.

The Benedyk Patent (U.S. Pat. No. 5,046,546) discloses a screened enclosure structure in which the screen panels are detachably removable from the frame member. However, the screen panels disclosed under the Benedyk Patent are not attached by a zipper.

The Zadok Patent (U.S. Pat. No. 6,192,643) discloses a modular screened enclosure system which is used for a pool deck or the like. However, the enclosure system disclosed under the Zadok Patent does not include detachable screen panels that are attached via a zipper attaching means.

The Narron Patent (U.S. Pat. No. 6,032,684) discloses a privacy screen for use on a deck or porch which has detachable panels. However, the detachable panels disclosed under the Narron Patent do not use a zipper as n attaching means.

The Antinone Patent (U.S. Pat. No. 3,763,917) discloses a detachable screen which is used in protecting porches, terraces, and the like. However, the detachable screen does not utilize a zipper as the attaching means.

The Hansen Patent (U.S. Pat. No. Des. 461,562) illustrates a design for a screened enclosure.

In light of the above discussed prior art there is a need for a detachable screen assembly involving a zipper, hook and grommet, nylon hook and loop, or snap buttons as the attaching means.

BRIEF SUMMARY OF THE INVENTION

The invention is a detachable insect screen system that uses a zipper as the attaching means of the detachable panel. The insect screen system also incorporates a permanent panel that encompasses the detachable panel. The permanent panel connects to the surrounding structure and has an opening with the corresponding teeth for the zipper assembly. An alternative embodiment may use a plurality of snap buttons, hook and grommets, or hook and loop fastening means, as opposed to a zipper in order to make ingress and egress of the insect screen assembly.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
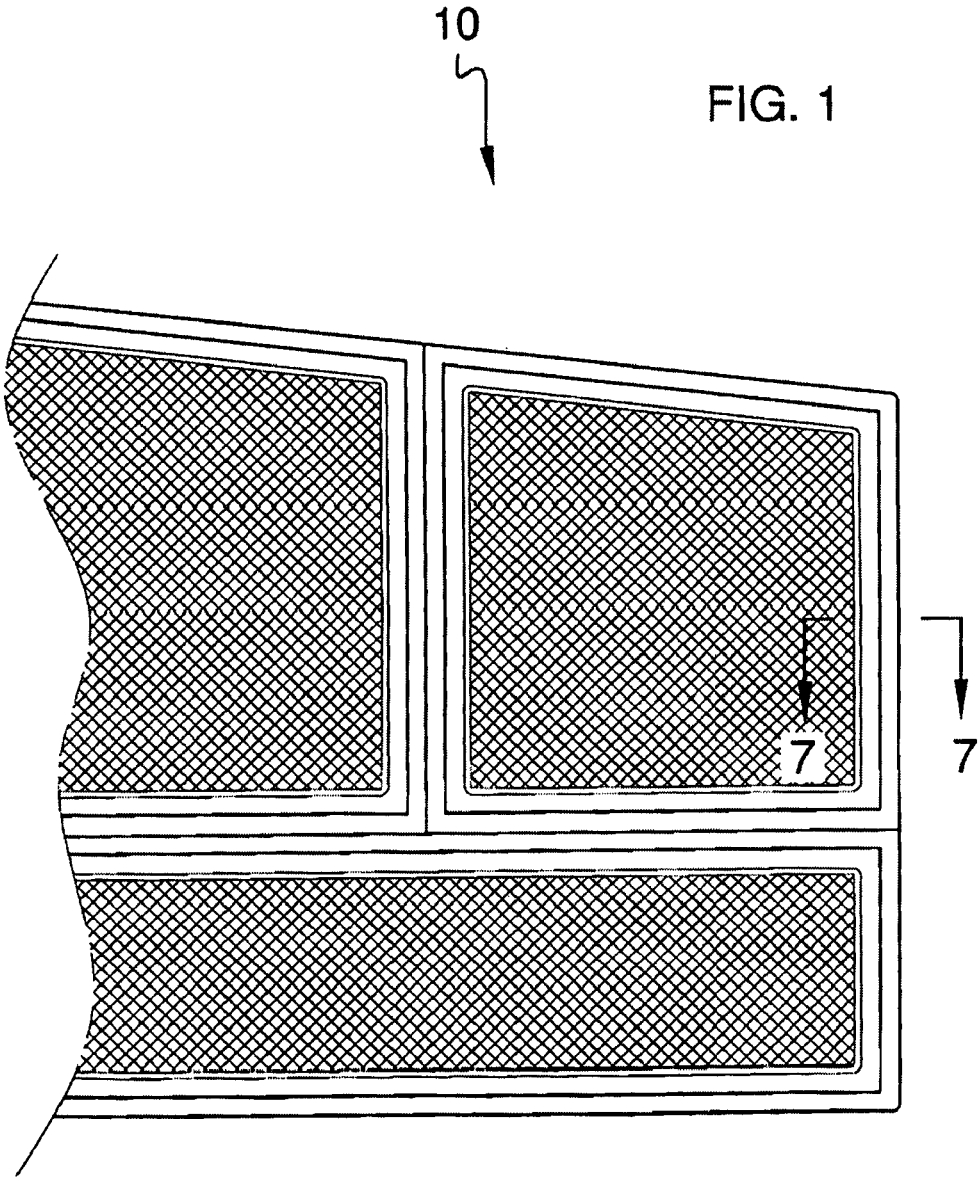
FIG. 1 illustrates an isometric rendering of the zipper embodiment of the invention in use.

Detailed reference will now be made to the preferred embodiments of the present invention, examples of which are illustrated in FIGS. 1-12. Referring to FIG. 1, an insect screen assembly 10 (hereinafter window embodiment) is capable of being attached to a frame of a window by a plurality of means.

Figure 2:
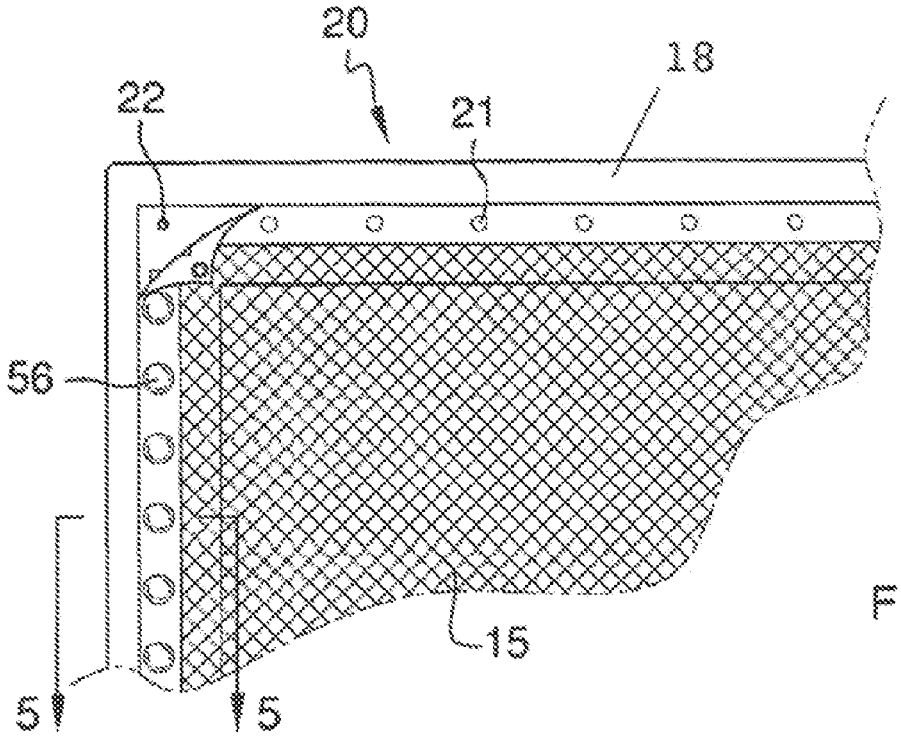
FIG. 2 illustrates a front view of the snap button embodiment of the invention.

Referring to FIG. 2, a button-snap embodiment 20 comprises a screen 15 that has located along the top, right, and bottom sides, a plurality of button-type snaps 21. Adorning an exterior edge of a frame 18 is a plurality of button-style snap bases 22.

Figure 3:
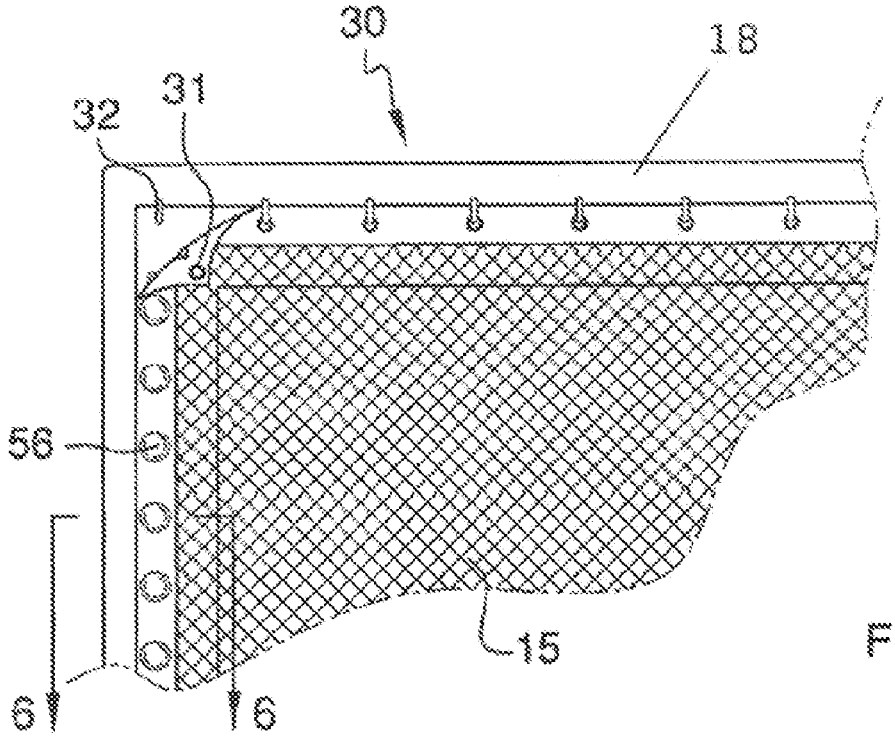
FIG. 3 illustrates a front view of the hook and grommet embodiment of the invention.

Referring to FIG. 3, a hook-and-grommet embodiment 30 comprises the screen 15. However, the screen 15 has located along the top, right, and bottom sides, a plurality of grommet fasteners 31. Adorning the exterior edge of the frame 18 is a plurality of hooks 32.

Figure 4:
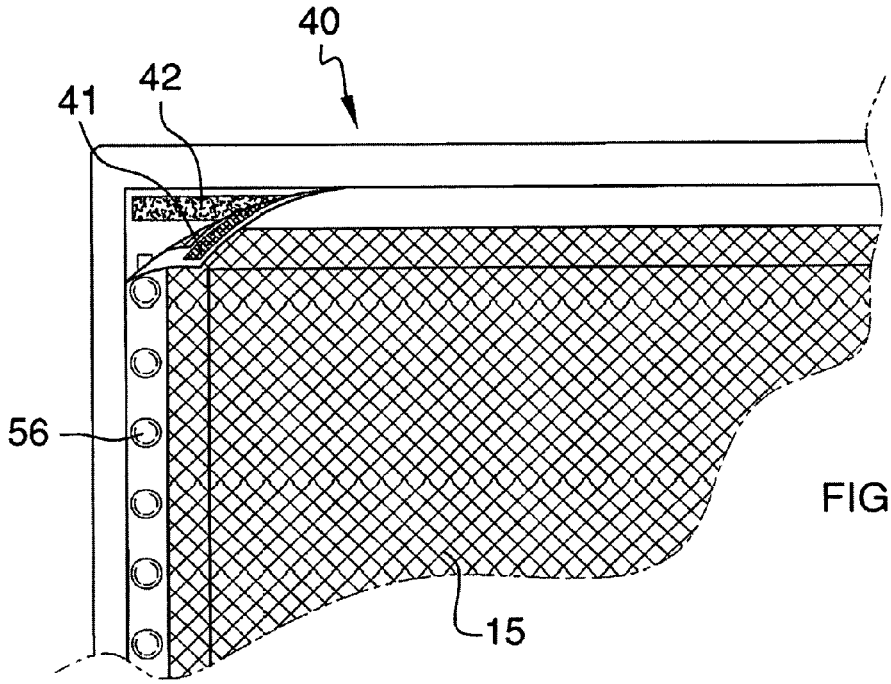
FIG. 4 illustrates a front view of the nylon hook and loop embodiment of the invention.

Referring to FIG. 4, a nylon hook and loop embodiment 40 comprises the screen 15, which is adorned along the interior edge with either nylon hook or loop material 41 or 42, respectively. Adorning the exterior edge of the frame 18 is the corresponding nylon loop and hook fastening strip 42 or 41, respectively.

Figure 11:
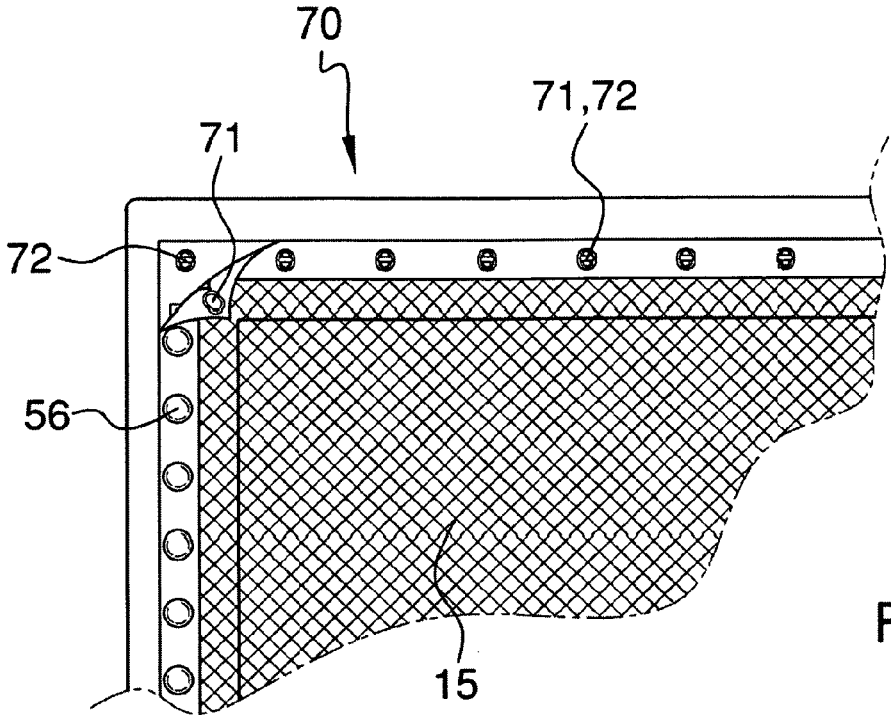
FIG. 11 illustrates a front view of a twist stud embodiment of the invention.
Figure 12:
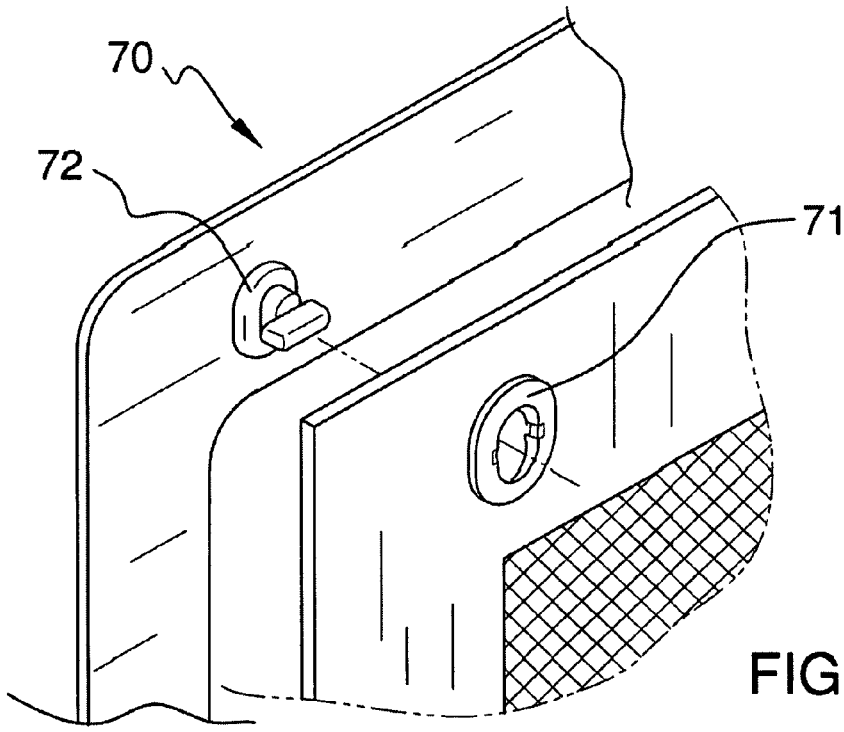
FIG. 12 illustrates a detailed view of the twist stud.

Referring to FIGS. 11 and 12, a twist stud embodiment 70 includes the screen 15. However, the screen 15 has located along the top, right, and bottom sides, a plurality of twist stud openings 71. Adorning the exterior edge of the frame 18 and corresponding to the twist stud openings 71 are a plurality of twist studs 72, which can rotate to lock and unlock the twist stud 72 with respect to the twist stud openings 71.

Figure 5:
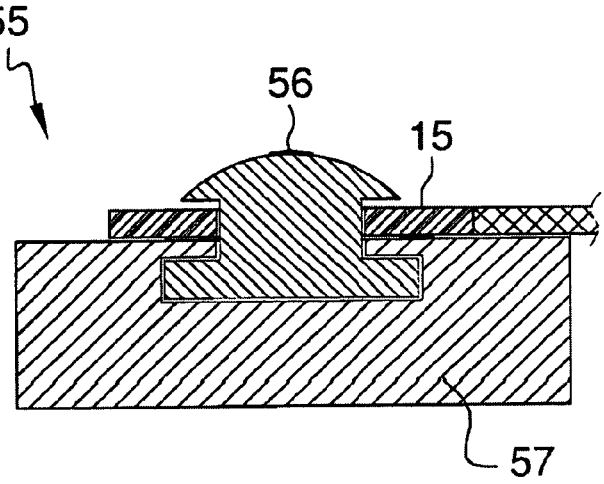
FIG. 5 illustrates a cross-sectional view of a track assembly integrated into the frame along line 5-5 in FIG. 2.

In FIGS. 2 and 3, there is located along the left side of the screen 15 a track assembly 55. The track assembly 55 comprises a plurality of guide wheels 56, which are capable of traversing up or down a guide track 57. More detail of the track assembly 55 is provided in FIGS. 5 and 6. As depicted in FIG. 5, the guide track 57 of FIG. 2 is integrated into an existing window frame 18. The guide wheels 56 have a button-styled head that protrudes through the outer, exterior surface of the screen 15.

Figure 6:
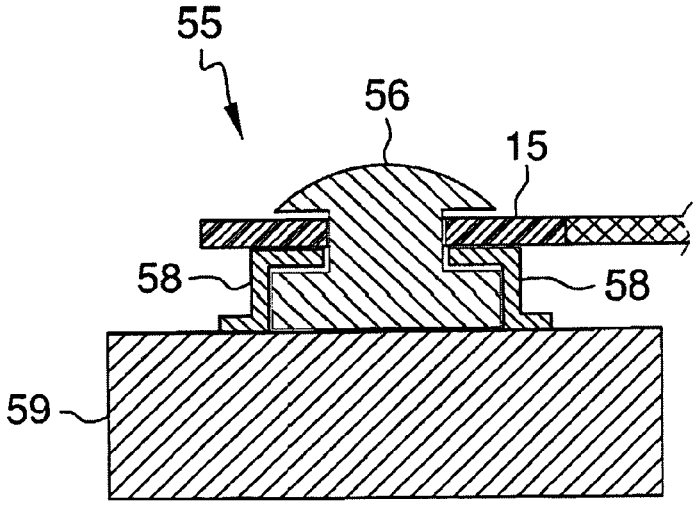
FIG. 6 illustrates a cross-sectional view of a track assembly that is mounted to the exterior surface of an existing frame along line 6-6 in FIG. 3.

Referring to FIG. 6, an alternative embodiment of the track assembly 55 is depicted as having a guide track 58 secured along the top, outer surface of a window frame 59.

It shall be noted that the window embodiment 10 may be adapted for use over other types of openings in and around a home.

Figure 9:
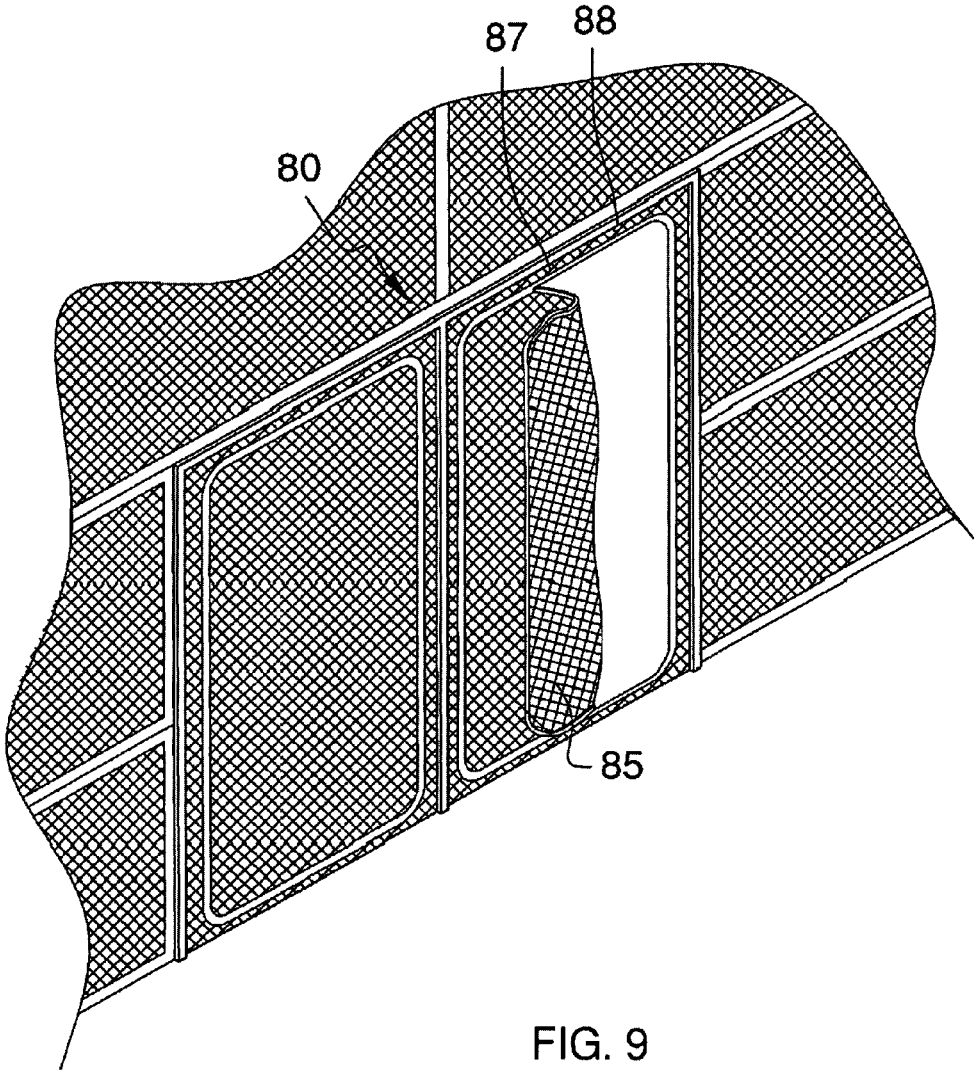
FIG. 9 illustrates an isometric view of the invention in use over an existing sliding glass door.
Figure 10:
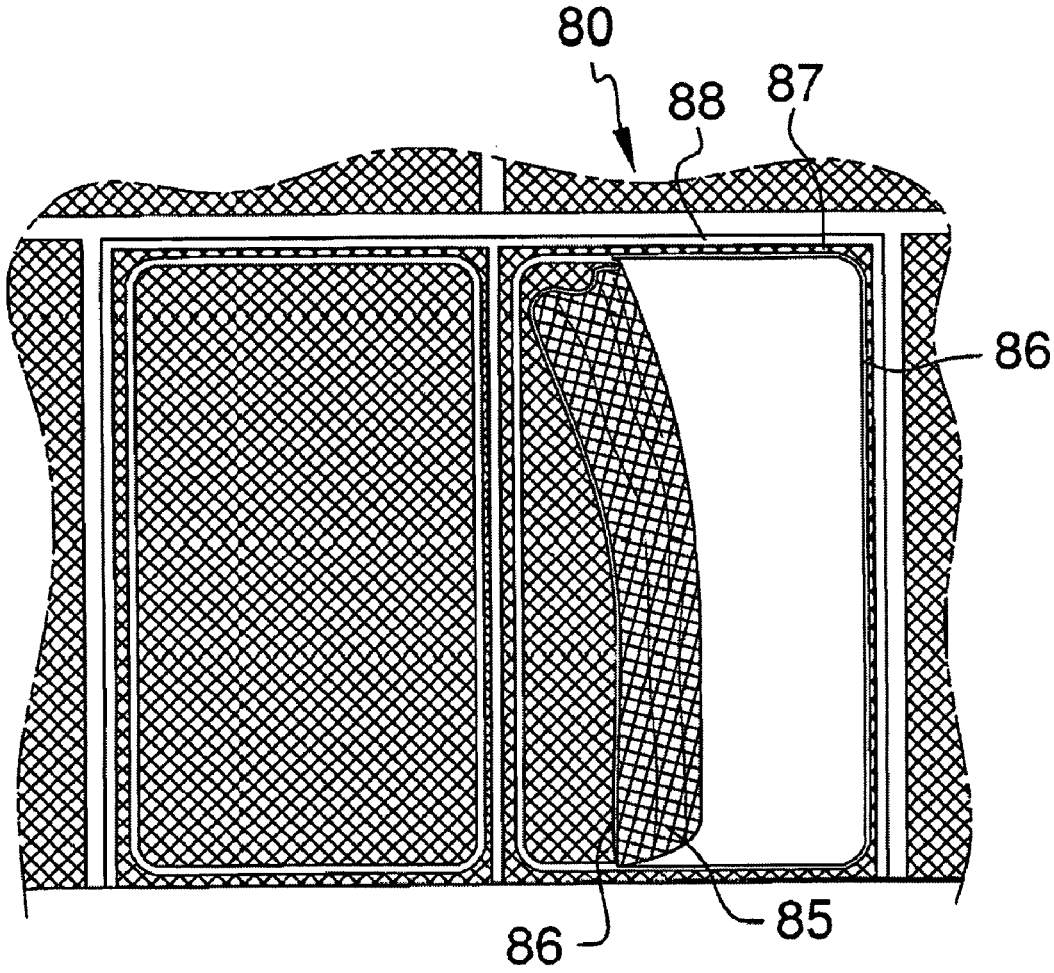
FIG. 10 illustrates a front view of the invention in use.

Referring to FIGS. 9 and 10, an insect screen assembly 80 includes an inner panel 85, which has zipper teeth 86 running the entire circumference of the inner panel 85 excluding, the bottom portion.

The insect screen assembly 80 has an outer panel 87 that runs up the left and right side and top of the opening to be covered. The outer panel 87 has zipper teeth 86 running along the interior left and right side and top.

Figure 7:
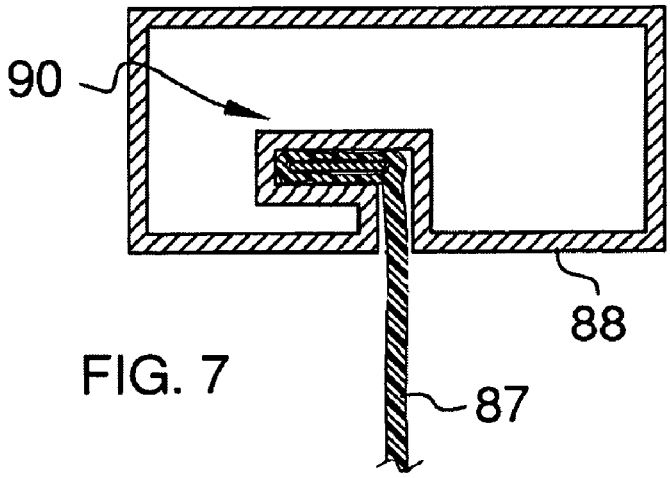
FIG. 7 illustrates a cross-sectional view of an outer panel of the zipper embodiment along line 7-7 in FIG. 1.

The exterior edge of the outer panel 87 is connected to a frame 88, which may be made of a weather resistant material such as plastic or non-oxidizing metal. The exterior edge of the outer panel 87 connects to the frame 88 by a water tight track system 90, as depicted in FIGS. 1 and 7.

It shall be noted that the embodiments depicted in FIGS. 9 and 10, may be adapted to exclude the outer panel 87, and thereby have an attaching means, such as a zipper, to attach the inner panel 85 attach directly to the frame 88.

Figure 8:
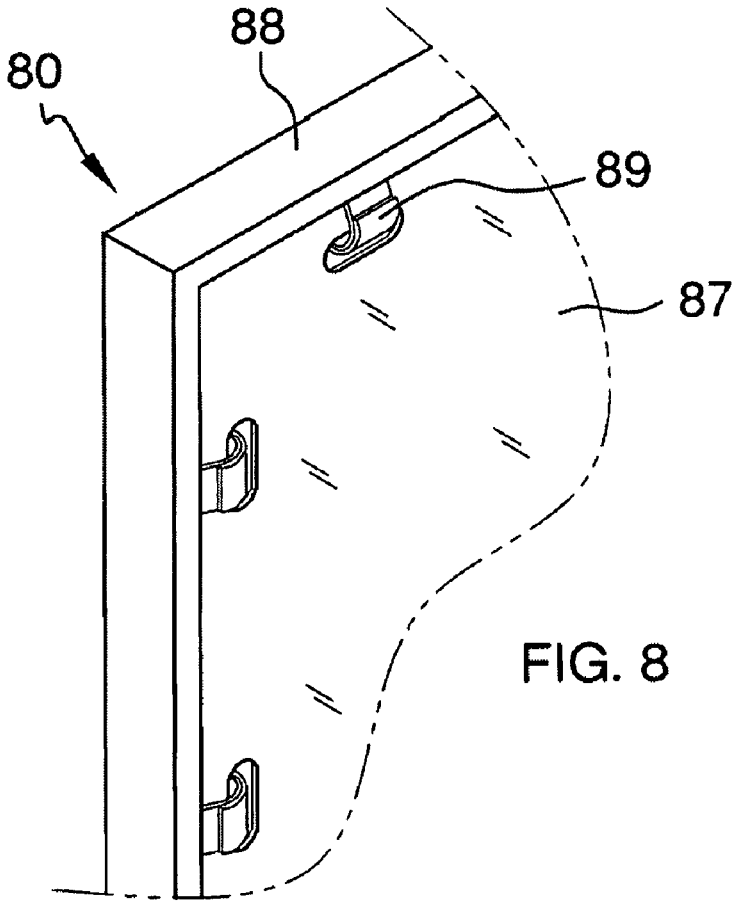
FIG. 8 illustrates a detailed view of an embodiment having an outer panel that is secured to an existing frame by a plurality of straps.

Referring to FIG. 8 will illustrate an alternative embodiment of the insect screen assembly 80, whereby the exterior edge of the outer pane 87 may connect to the frame 88 by a plurality of straps 89. If the attaching means employ straps 89, as depicted in FIG. 8, then a hole cover (not shown) may be used to cover openings where the straps 89 connect to the outer pane 87 in order to provide a barrier to prevent insects from entering.

It is being asserted that a primary advantage of the invention is to provide an insect screen barrier that can be easily opened and closed. Furthermore, the invention provides the ability to be removed so as to prevent it from being damaged by a Hurricane or other severe weather.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An insect screen assembly:

a) a screen;

wherein the screen has a portion of fasteners comprising either button-type snaps, hook and grommets, or nylon hook and loops that are located along a top, right, and bottom sides of the screen;

b) a window or door frame;

wherein the exterior edge of the frame has a plurality of fastener portions that correspond with the fastener portions attached to the top, right, and bottom sides of the screen;

c) a guide track;

wherein the guide track is mounted along the left side of the window or door frame;

d) a plurality of guide wheels;

wherein the guide wheels are secured along the left side of the screen; and wherein the guide wheels are designed to be inserted and traverse back and forth within the guide track.

* * * * *